US007914305B2

(12) United States Patent
Amleshi et al.

(10) Patent No.: US 7,914,305 B2
(45) Date of Patent: Mar. 29, 2011

(54) BACKPLANE CONNECTOR WITH IMPROVED PIN HEADER

(75) Inventors: Peerouz Amleshi, Lisle, IL (US); John Laurx, Aurora, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/214,612

(22) Filed: Jun. 20, 2008

(65) Prior Publication Data

US 2009/0011655 A1 Jan. 8, 2009

Related U.S. Application Data

(60) Provisional application No. 60/936,386, filed on Jun. 20, 2007.

(51) Int. Cl.
*H01R 4/66* (2006.01)
*H01R 13/648* (2006.01)

(52) U.S. Cl. ..... 439/101; 439/607.01

(58) Field of Classification Search ..... 439/101, 439/108, 607.05–607.14, 607.01
See application file for complete search history.

(56) References Cited

U.S. PATENT DOCUMENTS 4,733,172 A 3/1988 Smolley
4,973,273 A 11/1990 DePriest
5,019,945 A 5/1991 Smolley
5,795,191 A 8/1998 Preputnick et al.
6,146,202 A * 11/2000 Ramey et al. ..... 439/607.1
6,146,207 A 11/2000 Mulot
6,328,602 B1 12/2001 Yamasaki et al.
6,350,134 B1 2/2002 Fogg et al.
6,379,188 B1 4/2002 Cohen et al.
6,471,548 B2 10/2002 Bertoncini et al.
6,540,559 B1 4/2003 Kemmick et al.
6,652,318 B1 11/2003 Winings et al.
6,692,272 B2 2/2004 Lemke et al.
6,743,057 B2 6/2004 Davis et al.
6,808,419 B1 10/2004 Korsunsky et al.
6,827,611 B1 12/2004 Payne et al.
6,843,687 B2 * 1/2005 McGowan et al. ..... 439/607.06
6,863,543 B2 * 3/2005 Lang et al. ..... 439/75
7,131,870 B2 11/2006 Whiteman et al.
(Continued)

FOREIGN PATENT DOCUMENTS

EP 0 924 812 A1 6/1999
(Continued)

OTHER PUBLICATIONS

International Search Report for PCT/US08/007754, Jan. 28, 2009.

*Primary Examiner* — Felix O Figueroa
(74) *Attorney, Agent, or Firm* — Stephen L. Sheldon

(57) ABSTRACT

A backplane electrical connector having a pin header that includes a one-piece housing supporting a plurality of columns of edge coupled differential signal pairs of contacts each separated by a ground contact. The pin header housing base is formed with a plurality of air passageways extending through the base, including an air passageway disposed between each signal contact in one column and an immediately adjacent signal contact in an adjacent column for electrically isolating the adjacent signal contacts from each other by an air dielectric medium. Core-outs which extend only partially through the housing base are provided between each signal contact and an adjacent ground contact in an adjacent column for further isolating differential signal pairs.

18 Claims, 10 Drawing Sheets

U.S. PATENT DOCUMENTS

| | | | | |
|---|---|---|---|---|
| 7,163,421 | B1 * | 1/2007 | Cohen et al. | 439/607.02 |
| 7,195,497 | B2 | 3/2007 | Hull et al. | |
| 7,267,515 | B2 | 9/2007 | Lappohn | |
| 7,332,856 | B2 | 2/2008 | Kijima et al. | |
| 7,338,321 | B2 | 3/2008 | Laurx | |
| 7,384,311 | B2 | 6/2008 | Sharf et al. | |
| 7,458,839 | B2 | 12/2008 | Ngo et al. | |
| 7,473,138 | B2 | 1/2009 | Tuin et al. | |
| 7,553,190 | B2 | 6/2009 | Laurx et al. | |
| 7,591,655 | B2 | 9/2009 | Fedder et al. | |
| 2001/0010979 | A1 | 8/2001 | Ortega et al. | |
| 2003/0171010 | A1 | 9/2003 | Winings et al. | |
| 2004/0043648 | A1 | 3/2004 | Houtz | |
| 2004/0097112 | A1 | 5/2004 | Minich et al. | |
| 2006/0172570 | A1 | 8/2006 | Minich | |
| 2007/0021001 | A1 | 1/2007 | Laurx et al. | |
| 2007/0021003 | A1 | 1/2007 | Laurx et al. | |
| 2007/0021004 | A1 | 1/2007 | Laurx et al. | |
| 2007/0049118 | A1 | 3/2007 | Reeser et al. | |
| 2007/0059952 | A1 | 3/2007 | Raistrick et al. | |
| 2009/0011642 | A1 | 1/2009 | Amleshi et al. | |
| 2009/0011643 | A1 | 1/2009 | Amleshi et al. | |
| 2009/0011644 | A1 | 1/2009 | Amleshi et al. | |
| 2009/0011645 | A1 | 1/2009 | Laurx et al. | |
| 2009/0011664 | A1 | 1/2009 | Laurx et al. | |
| 2009/0017681 | A1 | 1/2009 | Amleshi et al. | |
| 2009/0017682 | A1 | 1/2009 | Amleshi et al. | |
| 2009/0071682 | A1 | 3/2009 | Crawford | |

FOREIGN PATENT DOCUMENTS

| | | | |
|---|---|---|---|
| EP | 1 732 176 | A1 | 12/2006 |
| WO | WO 86/01644 | | 3/1986 |
| WO | WO 01/57964 | A1 | 8/2001 |
| WO | WO 2007/058756 | | 5/2007 |
| WO | WO 2007/076900 | A1 | 7/2007 |
| WO | WO 2008/002376 | | 1/2008 |
| WO | WO 2008/156856 | A2 | 12/2008 |

* cited by examiner

FIG.5
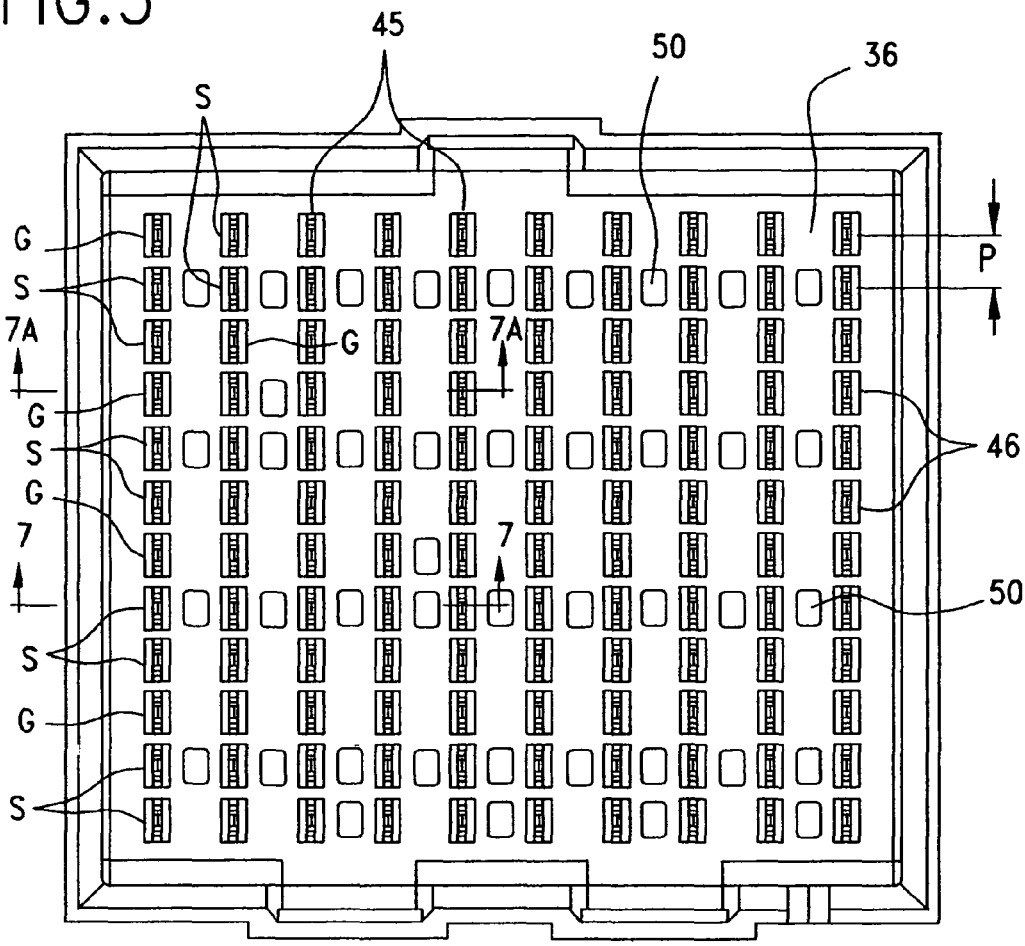
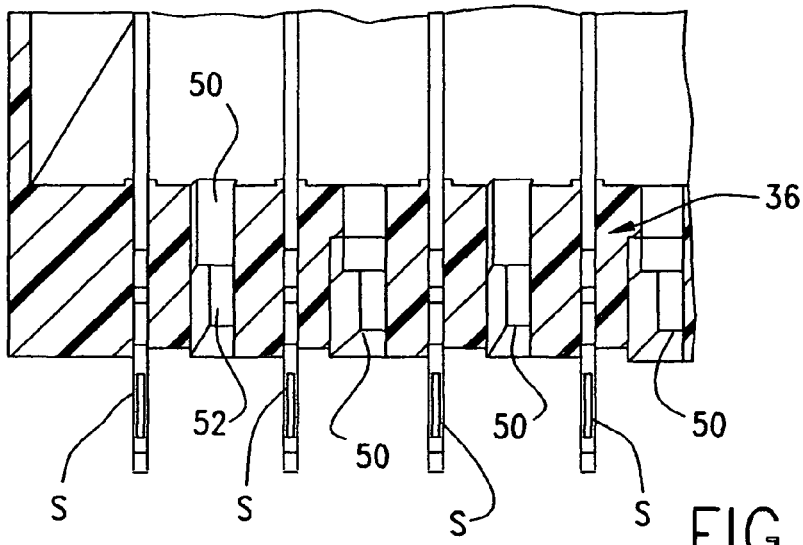
FIG.7

BACKPLANE CONNECTOR WITH IMPROVED PIN HEADER

REFERENCE TO RELATED APPLICATIONS

This application claims the domestic benefit of U.S. Provisional Application Ser. No. 60/936,386, filed on Jun. 20, 2007, which disclosure is hereby incorporated by reference.

BACKGROUND OF THE INVENTION

The present invention relates generally to electrical connectors, and more particularly to electrical connectors which comprise differential signal pairs of electrical contacts that are designed for high speed electronic communication.

Electrical connectors provide signal connections between electronic devices using signal contacts. Often, the signal contacts are so closely spaced that undesirable interference or cross talk can occur between adjacent signal contacts. Cross talk occurs when one signal contact induces electrical interference in an adjacent contact due to the overlapping of electrical fields, thereby compromising signal integrity. With electronic device miniaturization and high speed electronic communication becoming more prevalent, the reduction of cross talk becomes a significant factor in connector design.

One commonly used technique for reducing cross talk is to position separate electrical shields, in the form of metallic plates, for example, between adjacent signal contacts. The shields act to block cross talk between the signal contacts by eliminating the overlapping electrical fields. Shields, however, take up valuable space within the connector that could otherwise be used to provide additional signal contacts, and thus limit contact density and connector size. Shields also increase the cost of manufacture of the connector.

While it is known to use air gaps between signal contacts to enhance electrical isolation of adjacent contacts, the utilization of air gaps can: compromise the structural integrity of the connector or complicate the design of the connector by requiring a multiplicity of terminal supporting frames or wafers, as well as increase the physical size of the connector. In pin headers of backplane connectors, for example, it is desirable that the connector housing have a one-piece plastic design that will withstand significant forces during insertion of a daughter card connector into engaging relation with the multiplicity of pin header contacts. There is a need to improve electrical signal integrity in such pin header connectors consistent with signal integrity achieved by daughter card connectors which employ a plurality of separate signal contact-carrying wafers.

SUMMARY OF THE INVENTION

It is an object of the present invention to provide an electrical connector which has a relatively simple design and in which differential signal pairs of electrical contacts are effectively isolated by an air dielectric medium from signal contacts of adjacent or nearby differential signal pairs.

Another object is to provide an electrical connector as characterized above in which the connector housing has a one-piece molded construction and the air dielectric isolation of signal contacts is achieved without materially affecting the structural integrity of the connector.

A further object is to provide a pin header electrical connector of the above kind which has uniformly spaced electrical contacts adapted for economical manufacture and versatile usage.

A still further object of the present invention is to provide a pin header for use in high speed data transfer systems in which the pin header has a base supporting a plurality of contact pins that are mateable to an opposing daughter card connector. The contact pins being disposed in spaced-apart rows or columns and the base including selected openings formed therein and disposed between selected adjacent signal pins residing in different rows or columns.

These and other objects, features and advantages of the present invention will be clearly understood through a consideration of the following detailed description.

BRIEF DESCRIPTION OF THE DRAWINGS

In the course of this detailed description, reference will be frequently made to the attached drawings in which:

FIG. 5 is an enlarged plan view of the pin header connector as viewed from the mating side thereof;

FIGS. 7 and 7A are enlarged fragmentary sections of the illustrated pin header connector, taken along planes of lines 7-7 and 7A-7A, respectively in FIG. 5.

DETAILED DESCRIPTION OF THE PREFERRED EMBODIMENTS

Figure 1:
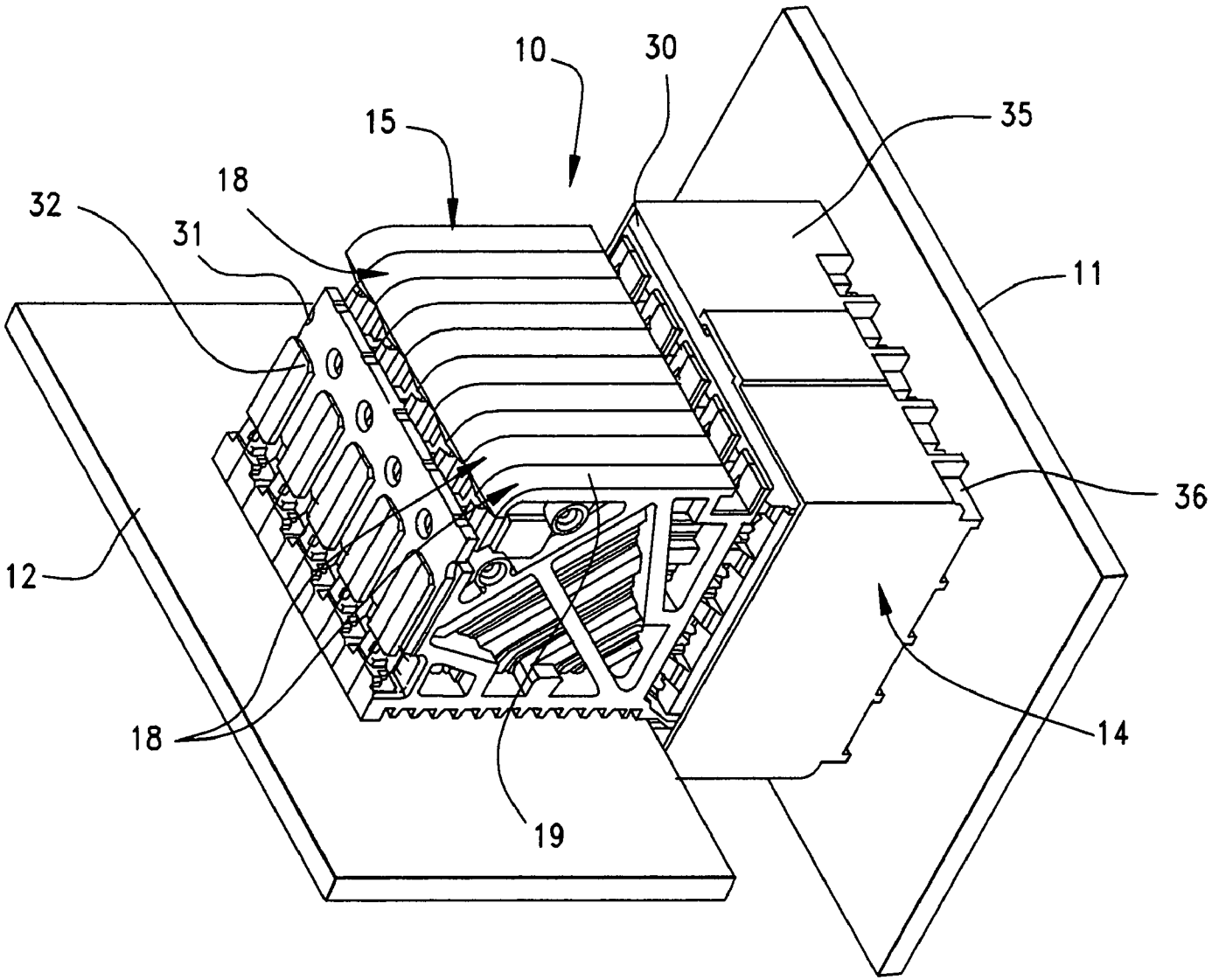
FIG. 1 is a perspective of an illustrative backplane connector in accordance with the invention, with a daughter card connector shown in inserted engaging relation with a pin header connector.

Referring now more particularly to the drawings, there is shown an illustrative backplane connector 10 in accordance with the invention for electrically connecting a printed circuit board (PCB) board in the form of a backplane 11 and a daughter PCB card 12. The backplane connector 10 includes a backplane pin header connector 14 mounted on the backplane 11 and a daughter card connector 15 mounted on the daughter card 12, which, as illustrated, are plugged together. Because the backplane 11 and daughter card 12 are arranged at a right angle to each other, the backplane connector 10 is a right angle connector and the electrical paths through connector accordingly change direction or bend 90°. However, it will be understood that in other embodiments, the backplane and daughter card can be arranged at other angles to each other, or parallel to each other, and the electrical paths can be arranged accordingly.

Figure 2:
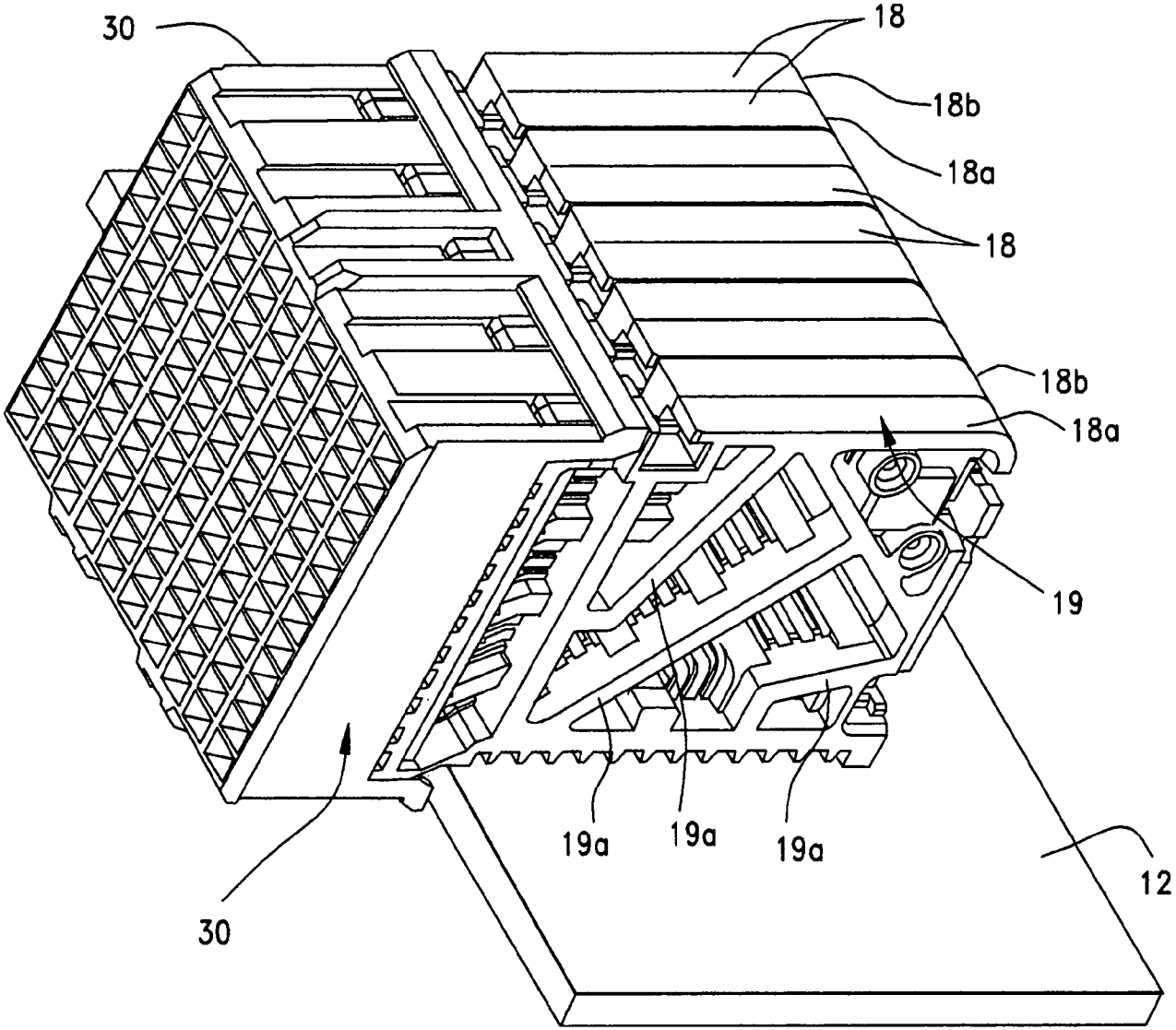
FIG. 2 is a perspective of the illustrated connector with the backplane removed.
Figure 2A:
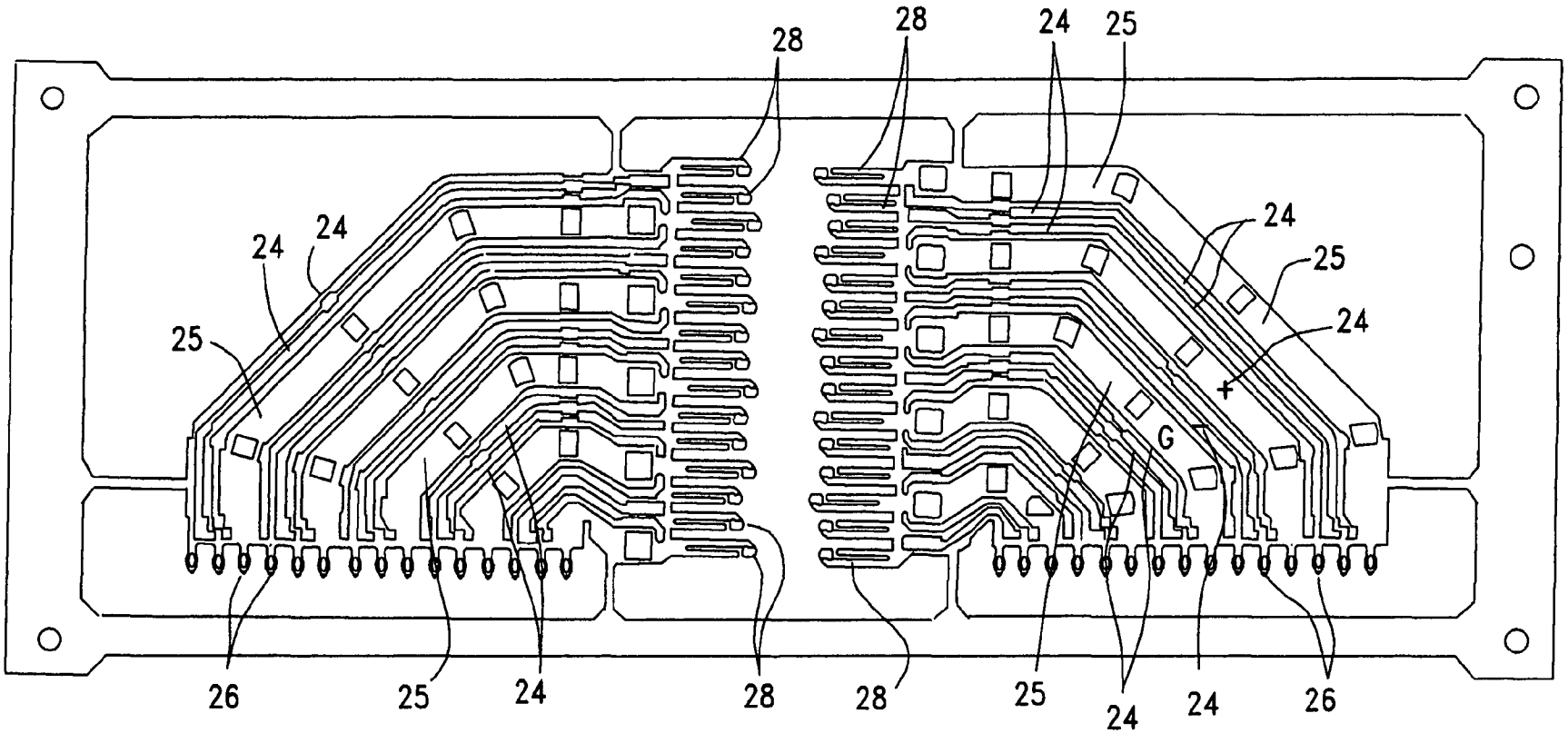
FIG. 2A is a plan view of a stamped lead frame for the signal and ground contacts for the individual wafers of the daughter card connector.

The daughter card connector 15 in this case comprises a plurality of wafers 18 arranged in a side-by-side configuration. As shown best in FIG. 2, each wafer 18 includes a first wafer half or waflet 18*a* and an opposing second wafer half or waflet 18*b* that are joined together. The waflets 18*a*, 18*b* are constructed of an insulative support frame 19, such as a thermoplastic material, disposed about a plurality of electrically conductive contacts 20. Each waflet 18*a*, 18*b* in this case includes comprises a column of contacts, which can be stamped from a lead frame as depicted in FIG. 2A, comprising pairs of edge-coupled differential signal contacts 24 located adjacent a ground contact 25. For electrically isolating the differential signal pairs of contacts 24 of one wafer from the differential signal pairs of the other wafer, the ground contacts 25 in this case have a transverse width corresponding substantially to the width of the differential signal pair and the ground contacts 25 and signal contacts 24 of one wafer are offset from the other wafer such that the signal contacts 24 on one wafer are adjacent to a ground contact 25 of the adjacent wafer with an air gap therebetween established by the mating relation of the waflets 18*a*, 18*b*.

The ground and signal contacts 24, 25 in each column extend roughly along parallel paths that transition generally 90° from a backplane face 130 of the daughter card connector to a mating face 132 of the daughter card connector. Each contact 24, 25 has a terminal end 26 in the form of a compliant pin for connection to the daughter board and a mating terminal end 28 for connection to the contacts of the pin header. The mating terminal ends 28 of the contacts in this case have a bifurcated dual beam design for redundant, more reliable connection with contacts of the pin header 14, as disclosed in more detail in U.S. Provisional Application No. 60/936,387 (Molex Case No. A7-151US-PRO), filed Jun. 20, 2007, the disclosure of which is incorporated herein by reference.

To produce the waflets, it will be understood that the plastic frame 19 may be insert molded over the electrical contact lead frame which can be stamped and formed from a thin conductive sheet metal, such as copper. The plastic support frame 19 in this case includes a plurality of ribs or spokes 19*a* designed to support the contacts 24, 25 and transfer insertion loads from the top part of the wafer 18 to the compliant tails 26 during insertion of the daughter card connector 15 into engaging relation with the pin header connector 14. The ribs 19*a* also serve as standoffs between two waflets 18*a*, 18*b*, when married for defining a predetermined spacing between the contacts 24, 25 of adjacent columns. One waflet preferably has male pegs which mate in press fit relation in holes in the opposite waflet to secure the married wafer, or other suitable means for joining two elements together including slots, adhesives, welding and the like. When married, it will be seen that the ground terminals 25 in each waflet are edge-coupled to a signal contact 26 of adjacent differential signal pair while being broadside coupled to the signal contacts of a differential signal pair in an adjacent column.

The wafers 18 are mounted within respective slots of a front shroud or housing 30 in parallel relation to each other and are secured together by a cross stiffener strip 31. The stiffener strip 31 preferably has slots that accept dovetails 32 on the back of each married wafer for maintaining proper spacing. The shroud or housing 30, as is known in the art, has openings within which the mating terminals 28 of the daughter card connector wafers are protectively disposed.

Figure 3:
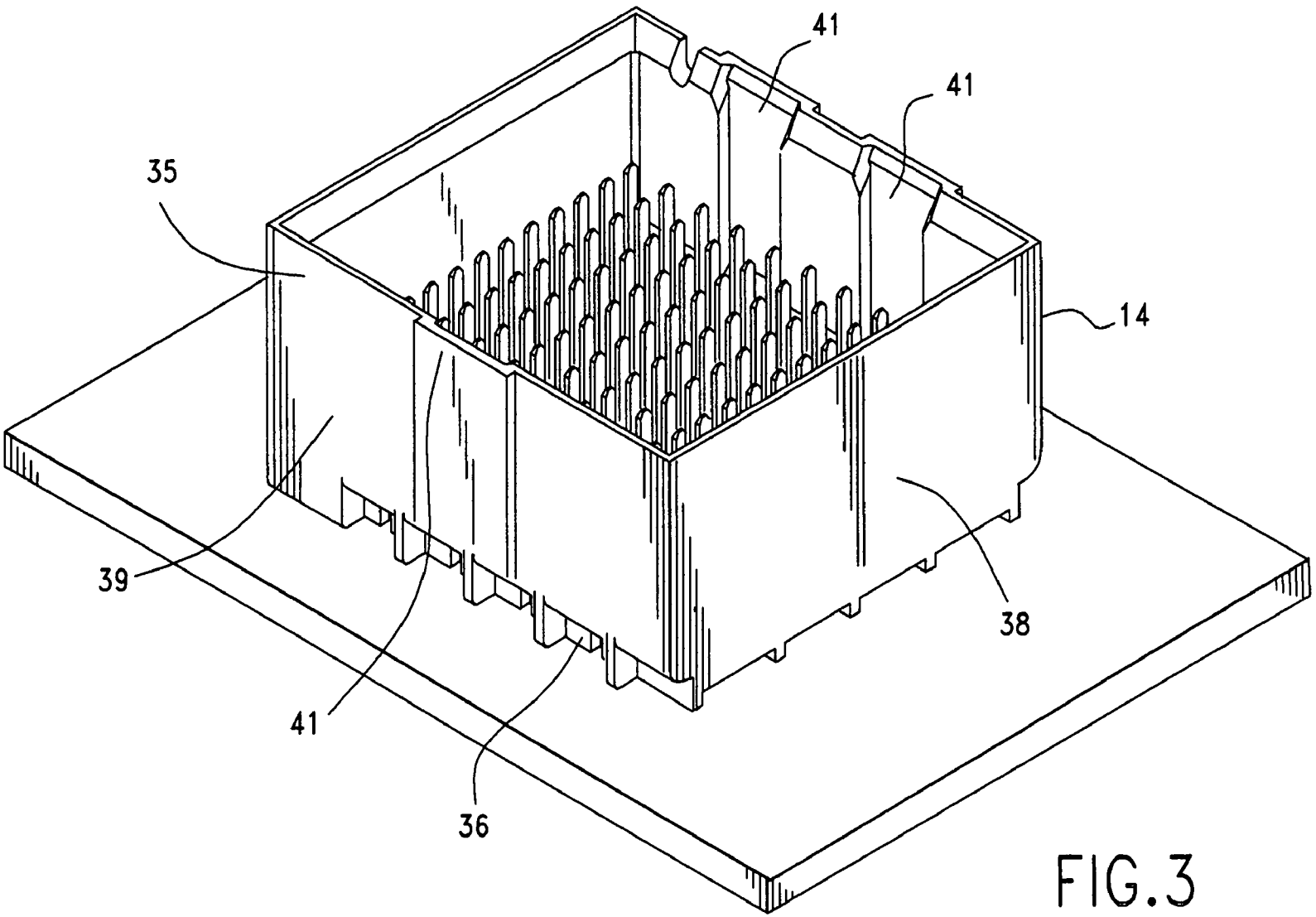
FIG. 3 is a perspective of illustrated the pin header connector in mounted relation on the backplane.

Turning now to FIG. 3, the pin header connector 14 comprises a one-piece, preferably plastic molded, housing 35 having a base 36 and upstanding side and end walls 38, 39, respectively. The base 36 is formed with a plurality of columns of slots each for receiving a respective column of electrical contacts 40. Each column of contacts 14 comprise a plurality of edge coupled differential signal pairs of contacts and adjacent ground contacts, respectively, sometimes referred to herein as S and G respectively for clarity of description. For purposes herein, the term "column" refers to the direction in which contacts are aligned edge to edge, and the term "row" refers to a direction perpendicular to that column.

Figure 4:
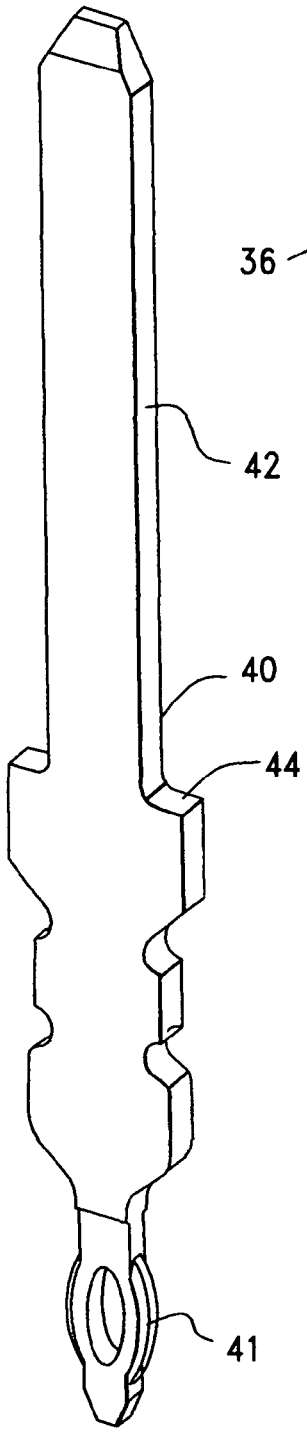
FIG. 4 is an enlarged perspective of one of the pin header connector contacts.

The ground and signal contacts 40 in this case are identically formed, each comprising, as depicted in FIG. 4, a stamped pin having a substantially coplanar flat shape with an elongated cross section oriented in aligned relation to the column within which the contact is located. Each contact 40, in this case, has a compliant terminal portion 41 at one end for connection to the backplane 11 and a mating portion 42 at an opposite end thereof for mating engagement with the bifurcated contacts 28 of the daughter card connector 15. Each contact 40 has a shoulder 44 intermediate the ends thereof for enabling the contacts to be installed into the housing with a simple press-in action, from a top or mating side of the connector 14, as opposed to common practice of inserting contacts into the housing from a bottom or mounting side. The contact design also facilitates removal after assembly.

Upon engagement of the daughter card connector 15 with the pin header connector 14 as an incident to insertion of the daughter card connector into the pin header connector, it will be seen that the bifurcated terminals 28 of the daughter card connector 15 will progressively contact and be moved into engagement with the mating terminals 42 of the pin header contacts 40. The pin header housing end walls 39 preferably are formed with offset recesses 41 to facilitate aligned engagement of the daughter card connector 15 with the pin header connector 14 upon mating, with the header housing recesses 41 providing a keying aspect for preventing improper mating.

Figure 5A:
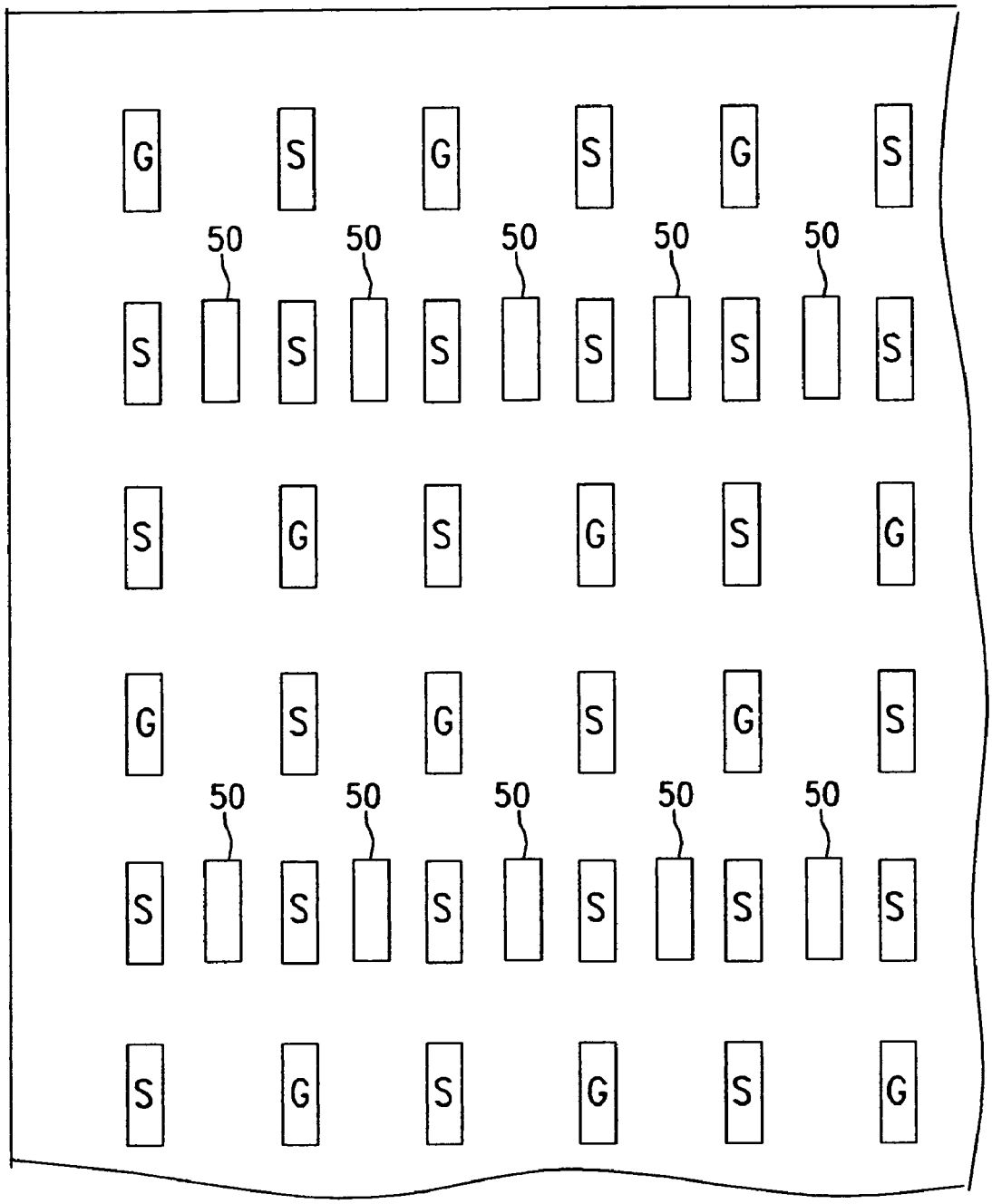
FIG. 5A is a fragmentary depiction of the contact arrangement of the illustrated pin header connector.

The signal and ground contacts S, G of the pin header connector 14, as best depicted in FIGS. 5 and 5A, are disposed in a uniform arrangement of columns 45 (shown in vertical arrays) and rows 46 (shown in horizontal arrays). Each column 45 comprises edge coupled differential signal pairs of contacts S-S separated by a respective ground contact G. The signal contacts S-S of alternating columns in this case are offset by a pitch "p" of the rows 46, such that one column 45, in the order from top to bottom, begins with a ground contact G and the next adjacent column begins with a signal contact S. As viewed in FIG. 5A, the first column on the left comprises, in order from top to bottom, a ground contact G, an edge coupled differential signal pair S-S, a ground contact G, a second differential signal pair S-S, a ground contact G etc. The adjacent column, beginning from the top, comprises a first differential signal pair S-S, a signal contact S, a second differential signal pair S-S, a ground contact G etc. By virtue of such arrangement, it can be seen that one signal contact S of each differential pair S-S is next to a signal contact S in the immediately adjacent column and the other signal contacts S of the differential pair is adjacent a ground contact G in the immediately adjacent column.

In accordance with an important aspect of the invention, and as shown in FIG. 7, the pin header connector housing base is formed with a predetermined pattern of core-outs 50 that define air passageways between the column of contacts that extend completely through the base for enhanced electrical isolation of the differential signal pairs without materially affecting the strength and rigidity of the connector housing and a series of partial core-outs that do not extend completely through the base 36 of the pin header connector 14. To this end, the base 36 of the pin header connector housing 35 is formed with a pattern of elongated core-outs or air passageways 50 between the columns of contacts, with one passageway 50 being disposed between a signal contact S of each differential pair in one column and an adjacent signal contact S in the immediately adjacent column. It will be understood that since air has a lower dielectric constant than plastic, the air passageway enhances electrical isolation of the signal contact of one differential pair in one column from an adjacent signal contact of a differential signal pair in the adjacent column. Since the other signal contact of each differential pair in the illustrated embodiment is adjacent a ground contact, in that instance the ground contact provides a shielding effect. By virtue of the greater distance of signal contacts of differential signal pairs that are not in immediately adjacent relation to each other, together with the shielding effect of the air passageways 50 and ground contacts G, signal integrity also is not significantly affected by the more remotely located differential signal pairs.

Hence, the differential signal pairs in each column are effectively isolated from electrical noise of differential signal pairs in adjacent columns so as not to impede the integrity of high speed signal communications through the connector. It will be seen that since the air passageways 50 are relatively small in size, corresponding in length substantially to the cross-sectional length of the signal contacts S and the base 36 is devoid of any other gaps or openings that extend through the base between the columns of contacts, the air passageways 50 do not materially alter the structural strength and integrity of the pin header housing 35, thereby not affecting its ability to withstand relatively high insertion forces that might be incurred upon mating insertion of a daughter card connector. Indeed, the air passageways 50 occupy a very small percentage of the area of the base, as established by the outer dimensions of the pin header connector housing 35.

Figure 7A:
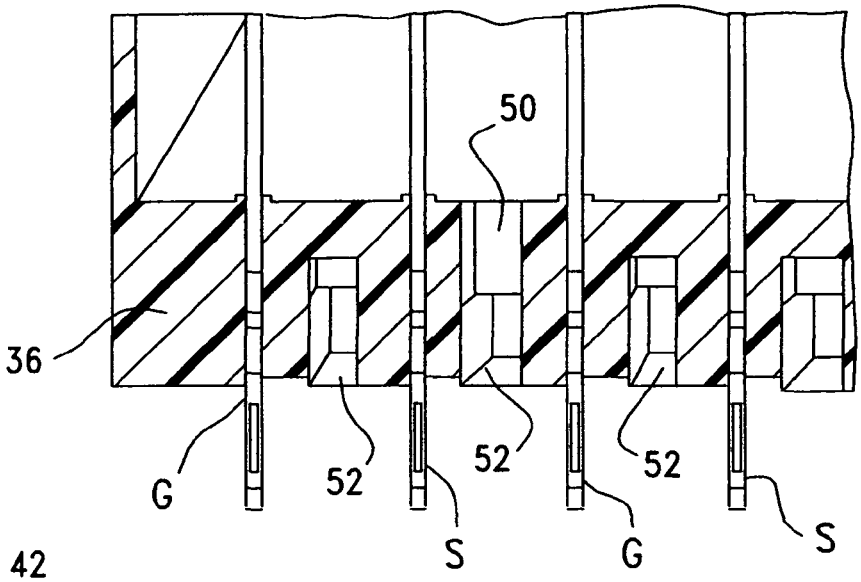
Figure 8:
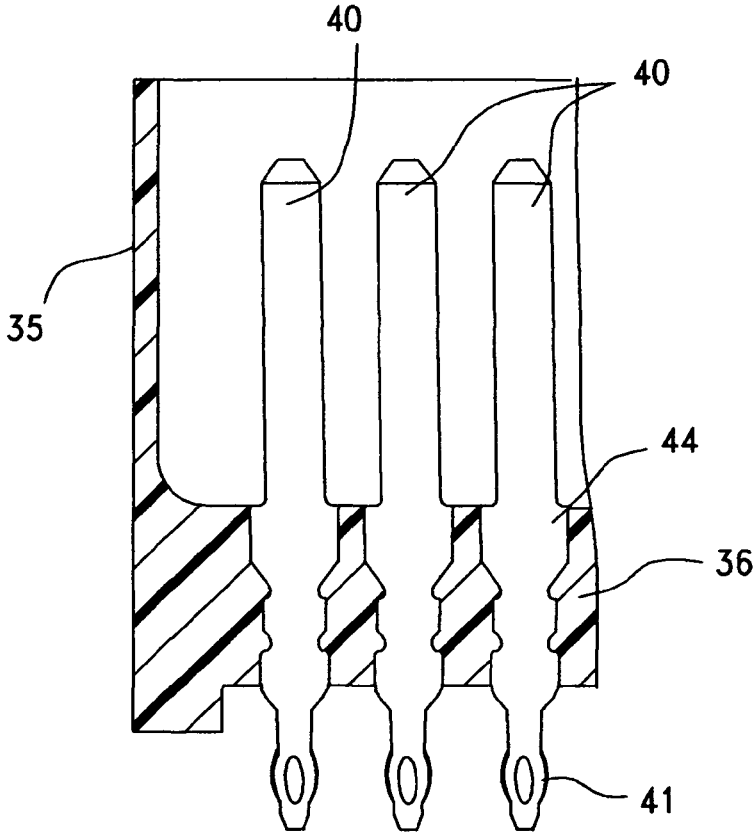
FIG. 8 is an enlarged fragmentary section of the illustrated pin header connector, taken parallel to the columns of contacts of the connector.

In accordance with a further aspect of the invention, as shown in FIG. 7A, the pin header base 36 is formed with a plurality of partial core-outs or recesses 52, which do not extend completely through the base 36, but which further isolate the signal contacts S of differential signal pairs from the signal contacts S of adjacent and nearby differential signal pairs. In this case, such partial core-outs 52 are disposed between each signal contact S and an adjacent ground contact G in an adjacent column. The core-outs 52 again have a length corresponding substantially to the elongated cross-sectional length of the contact, but extend only midway through the base 36, in this case from the mounting side of the base. The partial core-outs 52, in conjunction with the adjacent ground contacts G, further electrically isolate the signal contact S of adjacent and nearby differential signal pairs. Since the partial core-outs 52 do not extend completely through the pin header base, they also do not materially affect the structural rigidity of the housing. The partial core-outs 52 may serve as the basis to the complete core-outs 50, as shown in FIGS. 7 and 7A, meaning that the partial core-outs 52 may be first formed in the connector housing base 36 and the remainder of the base drilled therethrough to define the complete core-out 50.

Figure 5B:
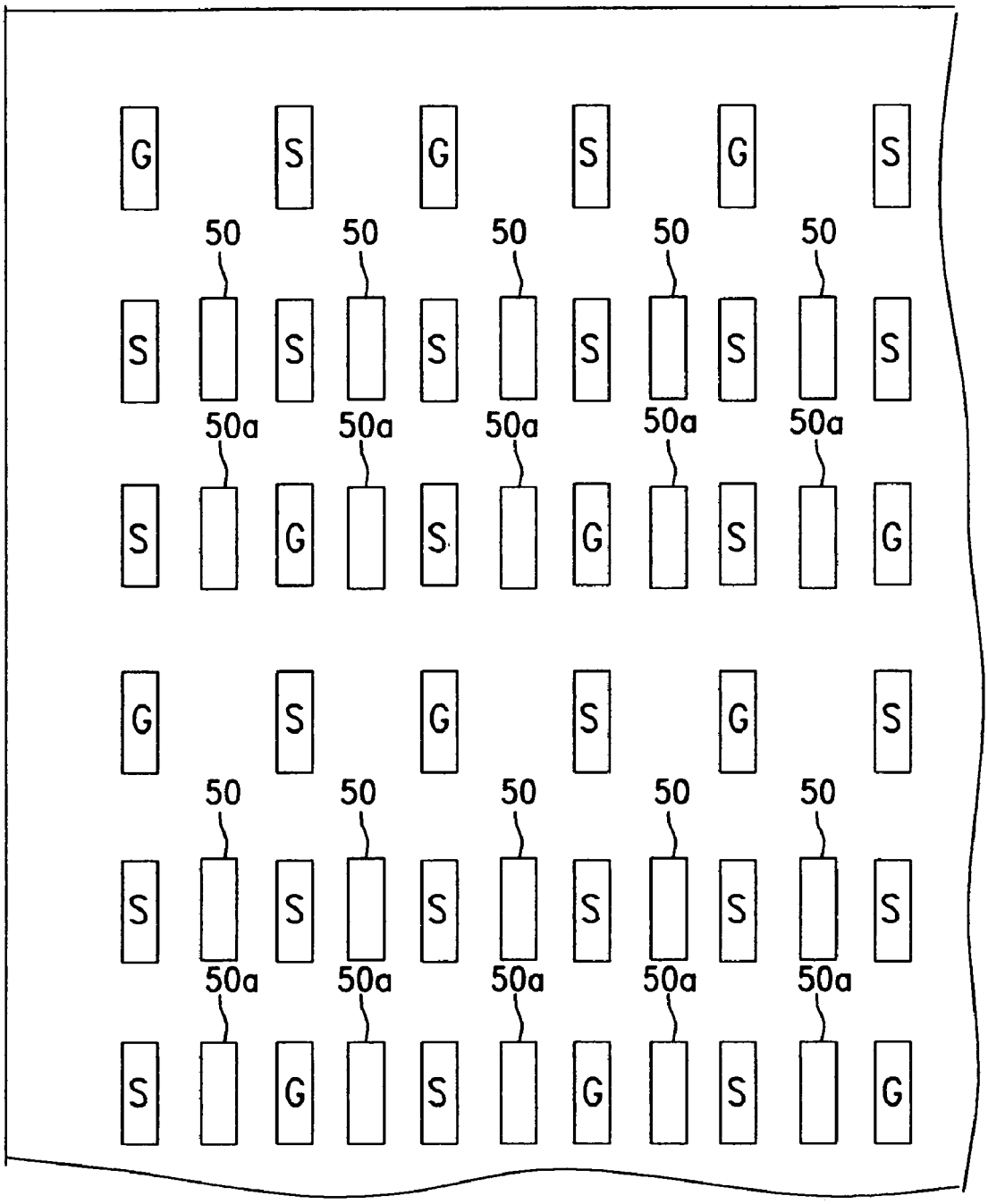
FIG. 5B is a fragmentary depiction, similar to FIG. 5A, of an alternative embodiment of the pin header connector.

Referring now to FIG. 5B of the drawings, there is shown an alternative embodiment of pin header connector in which pairs of air passageways 50, 50*a* are disposed on a common side of each differential signal pair of contacts S-S. Each air passageway 50 effects electrical isolation between the signal contact S in one column and the immediately adjacent signal contact S in an adjacent column, and the air passageway 50*a* is disposed between the other signal contact of each differential signal pair and the immediately adjacent ground contact for enhanced isolation of the signal contact from the other differential signal pairs. Again, since the air passageways are relatively small in size, they do not materially affect the structural integrity of the pin header housing.

Figure 5C:
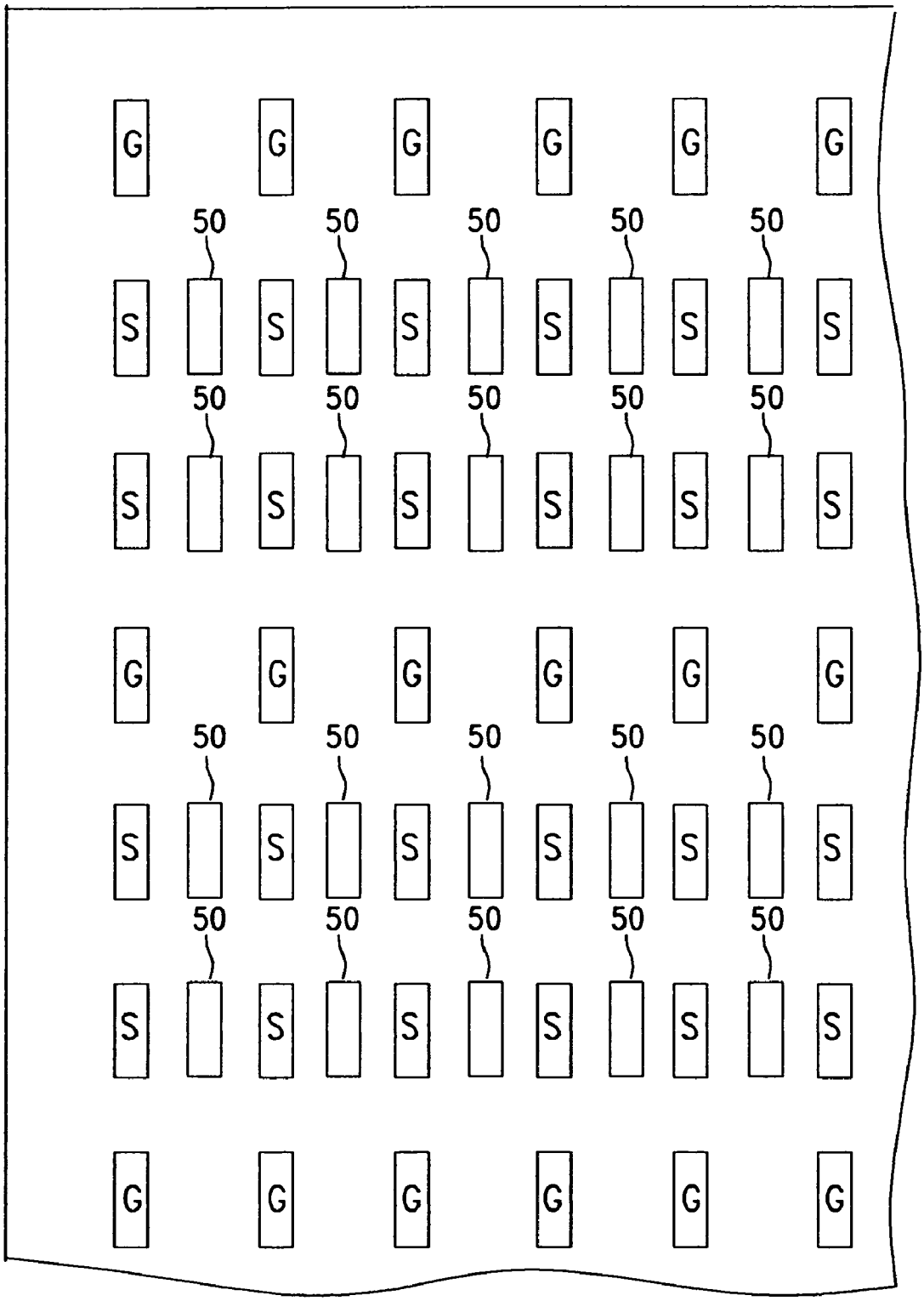
FIG. 5C is a fragmentary depiction of another alternative embodiment of a pin header connector.
Figure 6:
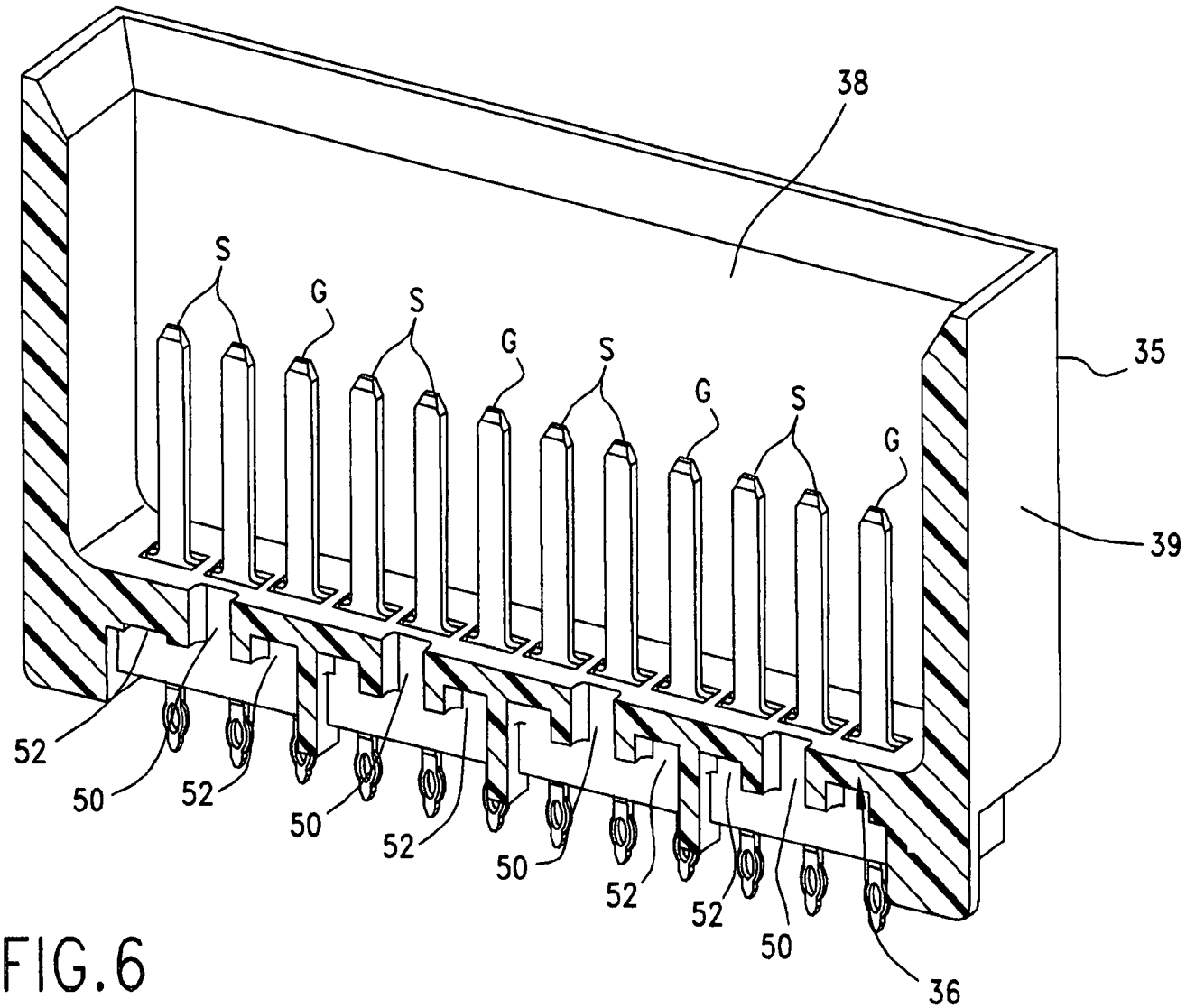
FIG. 6 is a perspective, vertical section of the pin header connector shown in FIG. 5.

Still a further alternative embodiment is depicted in FIG. 5C, in which each column of contacts in this case starts with a ground contact and in which pairs of air passageways 50 are disposed on a common side of each differential signal pair of contacts for electrically isolating the contacts of that differential signal pair with the adjacent contacts of a differential signal pair in the adjacent column. Again, the base 36 of the pin header connector housing 35 is devoid of any other openings or gaps that extend through the base between the columns of contacts.

From the foregoing, it can be seen that a backplane connector is provided in which both the daughter card connector and pin header connector have differential signal pairs which are isolated by an air dielectric medium from adjacent contacts of adjacent differential signal pairs for enhanced signal integrity in high speed communications. The air dielectric isolation of signal contacts in the pin header is achieved while permitting utilization of a one-piece plastic housing for structural integrity. The pin header also may be designed with uniform closely-spaced columns and rows of contacts for economical manufacture and versatile usage.

We claim:

1. An electrical connector, comprising:

a connector housing having a one-piece base for supporting a plurality of columns of electrical contacts, each of the columns including a plurality of pairs of edge-coupled differential signal contacts, each differential signal contact pair in the column being separated from another differential signal contact pair by a ground contact, at least one signal contact of each differential signal pair being disposed in adjacent relation to a signal contact of a differential signal pair in an immediately adjacent column, a plurality of air passageways extending through the base and disposed between the columns, and the passageways including a single air passageway disposed between each signal contact in one column and an immediately adjacent signal contact in an immediately adjacent column for electrically isolating the adjacent signal contacts of adjacent columns from each other by an air dielectric medium.

2. The electrical connector of claim 1, in which the electrical contacts each have an elongated coplanar cross-section aligned in parallel relation to the alignment of the columns.

3. The electrical connector of claim 2, in which the air passageways each have an elongated cross sectional shape corresponding in length to the elongated cross-sectional length of the signal contacts.

4. The electrical connector of claim 1, in which pairs of the air passageways are disposed adjacent a common side of the contacts of each differential signal pair.

5. The electrical connector of claim 4, in which the connector base is devoid of any other air passageways between the columns other than the pairs of air passageways.

6. The electrical connector of claim 1, in which air passageways adjacent signal contacts are disposed exclusively between the columns of contacts.

7. The electrical connector of claim 1, in which the one signal contact of each differential signal pair is disposed adjacent a ground contact in an adjacent column.

8. The electrical connector of claim 7, in which the base is formed with a plurality of recesses that extend only partially into the base, and the recesses including a recess disposed between each signal contact in one column and an immediately adjacent ground contact in an adjacent column.

9. The electrical connector of claim 1, in which the contacts are arranged in a uniform array of columns aligned in the edge-coupled direction of the differential signal pairs and rows aligned in a direction perpendicular to the direction of the columns.

10. An electrical connector, comprising:

a one-piece plastic molded housing having a base for supporting a plurality of columns of electrical contacts, each the column including a plurality of pairs of edge-coupled differential signal contacts with each differential signal contact pair being separated by a ground contact, a plurality of pairs of air passageways extending through the base between the columns, the air passageways of each pair being disposed adjacent a respective pair of edge-coupled differential signal contacts with one air passageway of each pair being located between one of signal contact of a differential signal pair and an adjacent contact in an adjacent column and the other air passageway being disposed between the other signal contact of the differential signal pair and an adjacent contact in an adjacent column for electrically isolating, by an air dielectric medium, the signal contacts of each differential signal pair from adjacent contacts in an adjacent column.

11. The electrical connector of claim 10, in which the contacts each have an elongated coplanar cross section aligned in parallel relation to the alignment of the columns, and the air passageways each have an elongated cross sectional shape corresponding in length to the elongated cross sectional length of the signal contacts.

12. The electrical connector of claim 10, in which pairs of the air passageways are disposed adjacent a common side of the contacts of each differential signal pair, and the connector base is devoid of any other air passageways between the columns other than the pairs of air passageways.

13. The electrical connector of claim 10, in which one signal contact of each differential signal pair is disposed adjacent a signal contact in an adjacent column, and one signal contact of each differential signal pair is disposed adjacent a ground contact.

14. A backplane electrical connector comprising;

a daughter board connector mountable on a daughter PC Board and having a plurality of columns of edge coupled differential signal pairs of contacts with each differential signal pair of contacts being separated by a ground contact, a pin header connector for mounting on a backplane and mating with the daughter card connector, the pin header connector having a housing with a one-piece base for supporting a plurality of columns of electrical contacts, each the column including a plurality of pairs of edge coupled differential signal contacts with each differential signal contact pair being separated by a ground contact, at least one signal contact of each differential signal pair of the electrical contacts supported by the one-piece base being disposed in adjacent relation to a signal contact of a differential signal pair in an immediately adjacent column, a plurality of air passageways extending through the base between the columns, and the passageways including an air passageway disposed between each signal contact in one column and an immediately adjacent signal contact in an adjacent column for electrically isolating the adjacent signal contacts of adjacent columns from each other by an air dielectric medium.

15. The electrical connector of claim 14, in which the contacts each have an elongated coplanar cross section aligned in parallel relation to the alignment of the columns, and the air passageways each have an elongated cross sectional shape corresponding in length to the elongated cross sectional length of the signal contacts.

16. The electrical connector of claim 14, in which pairs of the air passageways are disposed adjacent a common side of the contacts of each differential signal pair.

17. The electrical connector of claim 14, in which the one signal contact of each differential signal pair is disposed adjacent a ground contact in an adjacent column, the base being formed with a plurality of recesses that extend only partially into the base, and the recesses including a recess disposed between each signal contact in one column and an immediately adjacent ground contact in an adjacent column.

18. The electrical connector of claim 14, in which the contacts are arranged in a uniform array of columns aligned in the edge coupled direction of the differential signal pairs and rows aligned in a direction perpendicular to the direction of the columns.

* * * * *